US008997266B2

(12) United States Patent
DeBoer

(10) Patent No.: US 8,997,266 B2
(45) Date of Patent: Apr. 7, 2015

(54) ADJUSTABLE FACIAL PROTECTOR

(71) Applicant: John DeBoer, Spring, TX (US)

(72) Inventor: John DeBoer, Spring, TX (US)

( * ) Notice: Subject to any disclaimer, the term of this patent is extended or adjusted under 35 U.S.C. 154(b) by 0 days.

(21) Appl. No.: 14/187,524

(22) Filed: Feb. 24, 2014

(65) Prior Publication Data

US 2014/0165252 A1 Jun. 19, 2014

Related U.S. Application Data

(63) Continuation of application No. 12/958,274, filed on Dec. 1, 2010, now Pat. No. 8,695,122.

(60) Provisional application No. 61/285,181, filed on Dec. 10, 2009.

(51) Int. Cl.

| | |
|---|---|
| ***A42B 1/08*** | (2006.01) |
| ***A42B 3/20*** | (2006.01) |
| *A63B 71/10* | (2006.01) |

(52) U.S. Cl.

CPC . *A42B 3/20* (2013.01); *A63B 71/10* (2013.01); *A63B 2243/0045* (2013.01)

(58) Field of Classification Search

USPC ..... 2/9–11, 424, 425, 15

See application file for complete search history.

(56) References Cited

U.S. PATENT DOCUMENTS

| | | | | | |
|---|---|---|---|---|---|
| 287,331 | A | * | 10/1883 | Schaap | 2/9 |
| 364,543 | A | * | 6/1887 | Beach | 2/9 |
| 432,970 | A | * | 7/1890 | Blair | 2/9 |
| 552,557 | A | * | 1/1896 | Weber | 2/9 |
| 571,437 | A | * | 11/1896 | Gray | 2/9 |
| 1,696,198 | A | | 12/1928 | Gross | |
| 2,918,060 | A | | 12/1959 | Jules | |
| 2,944,263 | A | * | 7/1960 | Rayburn et al. | 2/9 |
| 3,139,624 | A | | 7/1964 | Humphrey | |
| 3,815,152 | A | | 6/1974 | Bednarczuk | |
| 3,992,722 | A | | 11/1976 | Rhee | |
| 4,587,677 | A | | 5/1986 | Clement | |
| 4,633,531 | A | | 1/1987 | Nimmons | |
| 4,885,806 | A | | 12/1989 | Heller | |
| 4,920,354 | A | | 4/1990 | Rauser | |
| 4,947,490 | A | | 8/1990 | Hayden | |
| 5,249,347 | A | * | 10/1993 | Martinitz | 29/460 |
| 5,384,914 | A | | 1/1995 | Caveness | |
| 5,571,220 | A | | 11/1996 | Hall | |
| 5,581,816 | A | | 12/1996 | Davis | |
| 5,661,849 | A | * | 9/1997 | Hicks | 2/9 |
| 5,694,649 | A | | 12/1997 | Helfling | |
| 5,956,777 | A | * | 9/1999 | Popovich | 2/424 |
| 5,963,990 | A | | 10/1999 | White | |
| 5,966,744 | A | * | 10/1999 | Smith, Jr. | 2/424 |
| 5,987,640 | A | | 11/1999 | Ryder | |

(Continued)

*Primary Examiner* — Richale Quinn

(74) *Attorney, Agent, or Firm* — DeBoer IP PC; John M. DeBoer

(57) ABSTRACT

A head gear assembly that includes a shell; a facial protector connectively attached to the shell that further includes a first element; a second element positioned approximately parallel to the first element; a third and fourth element positioned approximately perpendicular to one or both of the first element and the second element; a gap further comprising a gap size defined by the position of a combination of at least two of the first element, the second element, the third element, and the fourth element, wherein the gap size is adjustable between a plurality of gap sizes, wherein the first element is movingly engaged with the second element, and wherein the first element moves freely from the second element as the gap size is adjusted.

16 Claims, 13 Drawing Sheets

(56) References Cited

U.S. PATENT DOCUMENTS

| | | | | |
|---|---|---|---|---|
| 6,047,400 | A * | 4/2000 | Spencer | 2/9 |
| 6,292,954 | B1 * | 9/2001 | O'Bradaigh et al. | 2/424 |
| 6,301,719 | B1 | 10/2001 | Goodhand | |
| 6,324,700 | B1 | 12/2001 | McDougall | |
| 6,338,165 | B1 | 1/2002 | Biondich | |
| 6,938,273 | B2 | 9/2005 | Ko | |
| 7,434,268 | B2 * | 10/2008 | Futch | 2/9 |
| 7,540,034 | B2 * | 6/2009 | Bologna | 2/9 |
| 7,634,820 | B2 | 12/2009 | Rogers | |
| 7,765,608 | B2 * | 8/2010 | Durocher et al. | 2/9 |
| 7,870,618 | B2 | 1/2011 | Pilon | |
| 8,032,947 | B1 * | 10/2011 | Gait | 2/15 |
| 2003/0126665 | A1 | 7/2003 | Brown | |
| 2004/0163161 | A1 | 8/2004 | Morrow | |
| 2004/0250337 | A1 * | 12/2004 | Pietrzykowski | 2/195.3 |
| 2006/0000011 | A1 | 1/2006 | Reichow | |
| 2007/0044193 | A1 * | 3/2007 | Durocher et al. | 2/9 |
| 2007/0151003 | A1 | 7/2007 | Shih | |
| 2007/0250992 | A1 * | 11/2007 | Brown | 2/424 |
| 2008/0209617 | A1 | 9/2008 | Castillo | |
| 2010/0122402 | A1 | 5/2010 | Tipp | |

* cited by examiner

ADJUSTABLE FACIAL PROTECTOR

CROSS-REFERENCE TO RELATED APPLICATIONS

This application is a continuation of U.S. Non-Provisional patent application Ser. No. 12/958,247, filed Dec. 1, 2010, which claims the benefit under 35 U.S.C. §119(e) of U.S. Provisional Patent Application Ser. No. 61/285,181, filed on Dec. 10, 2009. The disclosure of each application is hereby incorporated herein by reference in its entirety for all purposes.

STATEMENT REGARDING FEDERALLY SPONSORED RESEARCH OR DEVELOPMENT

Not applicable.

BACKGROUND OF THE DISCLOSURE

1. Field of the Disclosure

Embodiments disclosed herein relate generally to protective head gear. Other embodiments disclosed herein relate to protective headgear assembly for sports or activities generally associated with eye and/or facial protection as part of protective head gear. Specific embodiments disclosed herein may relate to protective sports equipment, and particularly to a facial protector used with a hockey helmet.

For convenience and clarity, reference may generally be made to a hockey helmet throughout the disclosure, but it should be understood that the disclosure is not limited in any way by the description of embodiments as they may appear relevant to a hockey helmet. Further, "hockey" in itself is also not meant to be limited, and may include any form of the game, such as ice hockey, field hockey, street hockey, in-line hockey, roller hockey, floor hockey, etc.

2. Background

The evolution of head and facial protection design has long been synonymous with those that require protection by participating in an active lifestyle, especially that of industry and sport. Over time, technology has provided protection ranging from simplistic head protection in the form of helmets, to modern head protection that often demands a combination of complex designs with different concepts developed for any number of reasons, including the general concept of safety.

Helmets, rigid shells, or other forms protective head gear, are generally designed with a primary purpose to protect a user's head from injury in the event that a force, projectile, or other foreign object becomes a directed thereat. For example, a principal objective of helmets for use in an activity or sport may be user (e.g., wearer, player, etc.) safety. Government and/or other standards may exist that govern the performance of helmets intended for certain activities when subjected to any number of conditions.

However, a helmet by itself is oftentimes insufficient for full head protection because it may not protect a user's eyes, ears, mouth or other bodily areas. In the sport of hockey, for example, these areas are prone to contact with dangerous and/or fast-moving objects such as a stick or a puck, or possibly another player's fingers (or any other kind of projectile or foreign object), as well as other elements such as rain, snow, perspiration/sweat, etc.

With respect to various sports or activities, the prior art includes numerous features directed toward improvements in safety with regard to protecting a facial region, but often to the detriment of the user's performance. For example, one option may provide full facial protection by mounting a clear impact-resistant full visor or shield to the head gear; however, this option is limited by poor ventilation, as well as for other reasons explained in detail below.

Another option is a clear "half" visor or shield attached to the head gear, which is often done to provide the capability of the head gear to have better ventilation to prevent fogging. However, facial protection is now limited to only half the face. Sometimes these options are combined, such that there is "complete" facial protection with a half-shield in a combination with a half-cage that may provide a marginal compromise of safety/protection and user performance.

Another option includes the use of a "full" cage-type shield, which typically provides a greater amount of facial protection in combination with adequate ventilation in order to provide aid to a user's vision and performance, while still promoting safety and protection. This type of configuration is not limited to hockey, and comparable embodiments can be used for other sports or activities. There are also different embodiments for different aspects of a sport, such as a position player mask versus a goalie mask. Similarly, in baseball (or softball) there can be a position player mask versus a catcher mask.

A full cage-type or wire mesh face mask is well known in the art and may provide a better option to prevent the problem of accumulating moisture or perspiration that occurs on a visor or shield; however, these masks still lack the capability to provide a fully adequate range of vision for the user. Cages and masks adapted for head gear are further known for having some form of a rigid/static horizontal and vertical bar connection that forms a kind of grid across the face, as shown in FIG. 1.

Referring to FIGS. 1A and 1B, a full cage facial protector mounted to a head gear, is shown. FIGS. 1A and 1B together show a head gear assembly 1 that includes a head gear 10 with an attached cage 12. The cage 12 is formed by any means known to a person having ordinary skill in the art, such as by crossing and securing substantially vertical members 16 with substantially horizontal members 18. Typically, the cage 12 is attached to the head gear 10 in order to protect a face/head 14 and/or a facial region 20 from various elements, such as flying objects or the like.

As illustrated, the cage 12 has a plurality of gaps 2 disposed within the cage, and the size of any of the gaps 2 may be determined by, for example, a gap size 3. Typically, the gap 2 and the gap size 3 are static in nature (i.e., the dimensions do not change). When donned by a user, the static nature of members 16 and 18 become a hindrance to the performance of the head gear assembly 1 because the user's range of vision is impaired. The range of vision may include straight ahead vision, side-to-side vision, peripheral vision, as well as a line of sight vision, and is not meant to be limited in any way. As shown in FIG. 1, a user's line of sight P1 is directly impaired by horizontal member 16*a*.

Though a user may initially don the head gear assembly 1 without an initial range of vision impairment, any movement that occurs as a result of partaking in an activity typically subjects the user's line of sight to the members 16 and/or 18. Thus, the cage 12 interferes with the user's range of vision, even when the cage 12 is properly positioned, because the cage 12 moves relative to the user's face during use.

While no single mask or cage used today may be positioned in a manner to provide unlimited vision, there have been some attempts with limited success to improve vision. For example, the gap of a hockey goalie mask may have the vertical bars removed in order to aid vision, but this configuration still subjects a user to the dangers previously mentioned. These and other similar devices provide an unadjustable, static cage that connects typically to the front, side and/or other area of the helmet.

FIGS. 2A and 2B show a helmet 1 having some vertical bars removed from a protective mask, as well as making the mask itself adjustable to change a line of sight angle from x-x' to y-y', which functions by adjusting the mask to vertically move (i.e., pivot) the line of sight P1 of a user. However, while the line of sight P1 and/or direction of vision might change, the size of the gap does not. In other words, gap size 58 remains static at all times; instead of a dynamic gap size, the static gap size 58 is shifted downward by a distance 72, thereby changing the planar line of sight P1 to planar line of sight P2. Unfortunately, this configuration is still inadequate because the gap in the mask still subjects a user to the dangers previously mentioned. For example, FIGS. 2C and 2D illustrate an object O penetrating the mask both before and after the mask has been adjusted.

As may be understood from the description above, protective facial gear of the prior art provide a static gap size. While the gap itself might be moveable, this aspect does not account for the numerous differences of potential users that might require an ability to slightly change this gap size or to move the gap to a position where the impairment of vision is reduced accordingly because one user will naturally not have the same exact line-of-sight requirement as another. For example, during activities a user's head gear is often subjected to frequent head movements, characterized by repeated lowering and raising, or side-to-side turning of the head. While such movements are natural and necessary, the static gap size of the grid will generally interfere with or impair the user's vision at any given time.

Because a user's line-of-sight requirement can change over time, such as a span of time where a child grows from one size to another. Variances in users (e.g., adult, young adult, child, etc.), user characteristics (e.g., big head, small head, etc.), and user requirements (e.g., the activity the head gear is used for) create a need for facial protection that provides a dynamic gap size that may be adjustable between a range of gap sizes.

What is needed is a head gear with a facial protector that may provide a dynamic gap size. There is also a need for facial protection with a dynamic gap size, where the adjustment of the gap size does not detrimentally affect the user's line of sight. What is further needed is facial protector with a vision gap, where the size of the gap can be adjusted to enhance the performance of the head gear. It is desirable to provide a head gear that provides an appropriate balance between user safety and user performance.

SUMMARY OF DISCLOSURE

Embodiments disclosed herein provide for a head gear assembly that may include a shell (e.g., configured for wearability on a users head); and a facial protector connectively attached to the shell. The facial protector may include a first element; a second element positioned approximately parallel to the first element; a third and fourth element positioned approximately perpendicular to one or both of the first element and the second element; a gap further comprising a gap size defined by the position of a combination of at least two of the first element, the second element, the third element, and the fourth element. In aspects, the gap size may be adjustable between a plurality of gap sizes, the first element may be movingly engaged with the second element, and/or the first element may move freely from the second element as the gap size is adjusted.

The shell may include an inner portion; an outer portion coupled with the inner portion. In aspects, the inner portion and the outer may be are configured to form an opening that is restricted by the facial protector.

The head gear may be designed for use in contact sports. In aspects, the sport may be hockey related. In aspects, the head gear may be a hockey helmet.

The shell may include one or more of a first pivot mechanism; a second pivot mechanism; and an adjusting device. In aspects, the facial protector may piotably attach to the shell via at least one of the first pivot mechanism, the second pivot mechanism, and the adjusting device. In aspects, the gap size may be adjusted by operating the adjusting device.

The shell may include a first pivot mechanism; a second pivot mechanism; and an adjusting device. In aspects, the head gear is a helmet for a hockey-related sport. In aspects, the facial protector may pivotably attach to the shell via at least one of the first pivot mechanism and the second pivot mechanism. In aspects, the gap size may be adjusted by operating the adjusting device.

Other embodiments of the disclosure pertain to a head gear assembly for protecting a user's head that may include a shell; and a facial protector connectively attached to the shell. The facial protector may further include a plurality of generally vertically oriented elements; a plurality of elements arranged approximately perpendicular to one or more of the plurality of generally vertically oriented elements; and a gap further comprising a gap size. In aspects, the gap size may be adjustable between a plurality of gap sizes. In aspects, at least one of the plurality of generally vertical elements may have an upper portion movingly engaged with a lower portion. In aspects, the upper portion may moves freely from the lower portion as the gap size is adjusted.

The shell may include a left side; a right side; a top side; a first pivot mechanism disposed on the left side; a second pivot mechanism disposed on the right side; and an adjusting device disposed on the top side. In aspects, the facial protector may connectively attaches to the rigid shell via the first pivot mechanism, the second pivot mechanism, and/or the adjusting device.

The gap size may be adjusted by operating the adjusting device. The head gear may be a hockey helmet. The facial protector may include an upper portion movingly engaged with a lower portion.

Yet other embodiments of the disclosure pertain to a head gear assembly that may include a shell configured use on a human head, the shell further having an inner portion and an outer portion coupled with the inner portion; a facial protector connectively attached to the shell, the facial protector further having a first element; a second element positioned approximately parallel to the first element; a third and fourth element positioned approximately perpendicular to one or both of the first element and the second element; a gap further comprising a gap size defined by the position of a combination of at least two of the first element, the second element, the third element, and the fourth element. In aspects, the gap size may be adjustable between a plurality of gap sizes. In aspects, the first element may be movingly engaged with the second element. In aspects, the first element may move freely from the second element as the gap size is adjusted. In aspects, the inner portion and the outer portion may be configured to form an opening that is restricted by the facial protector.

The shell of the head gear assembly may include a pivot mechanism configured form pivotable attachment of the facial protector therewith. The head gear assembly may include an adjusting device. The gap size may be adjusted by operating the adjusting device.

Other aspects and advantages of the disclosure will be apparent from the following description and the appended claims.

BRIEF DESCRIPTION OF DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
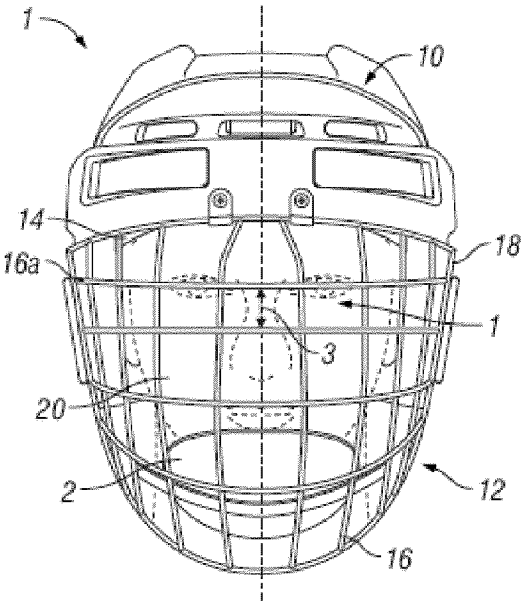
FIG. 1A (Prior Art)
FIGS. 1A and 1B show a full cage facial protector mounted to a head gear.
Figure 1B:
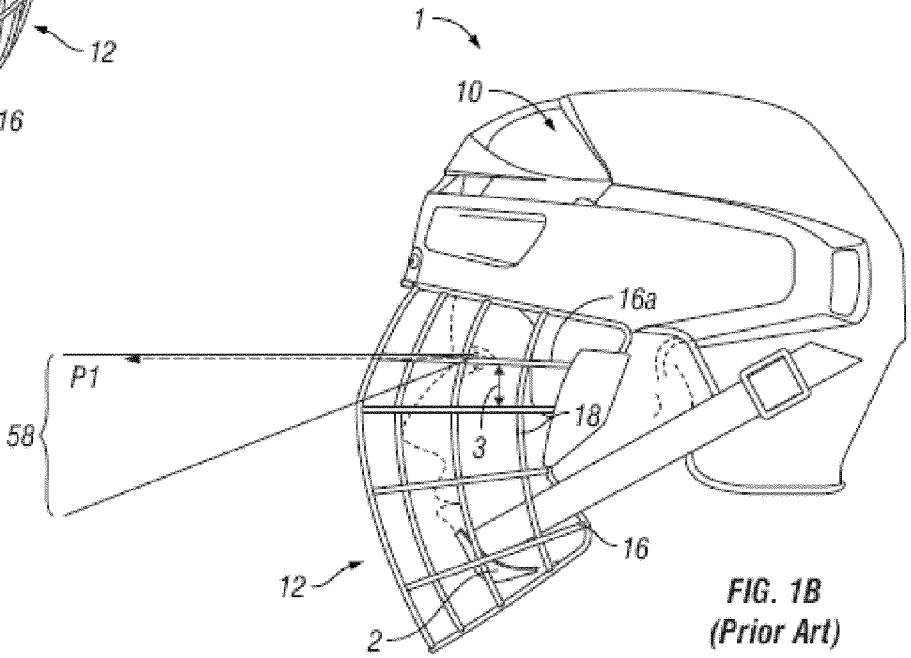
FIG. 1B (Prior Art)
Figure 2A:
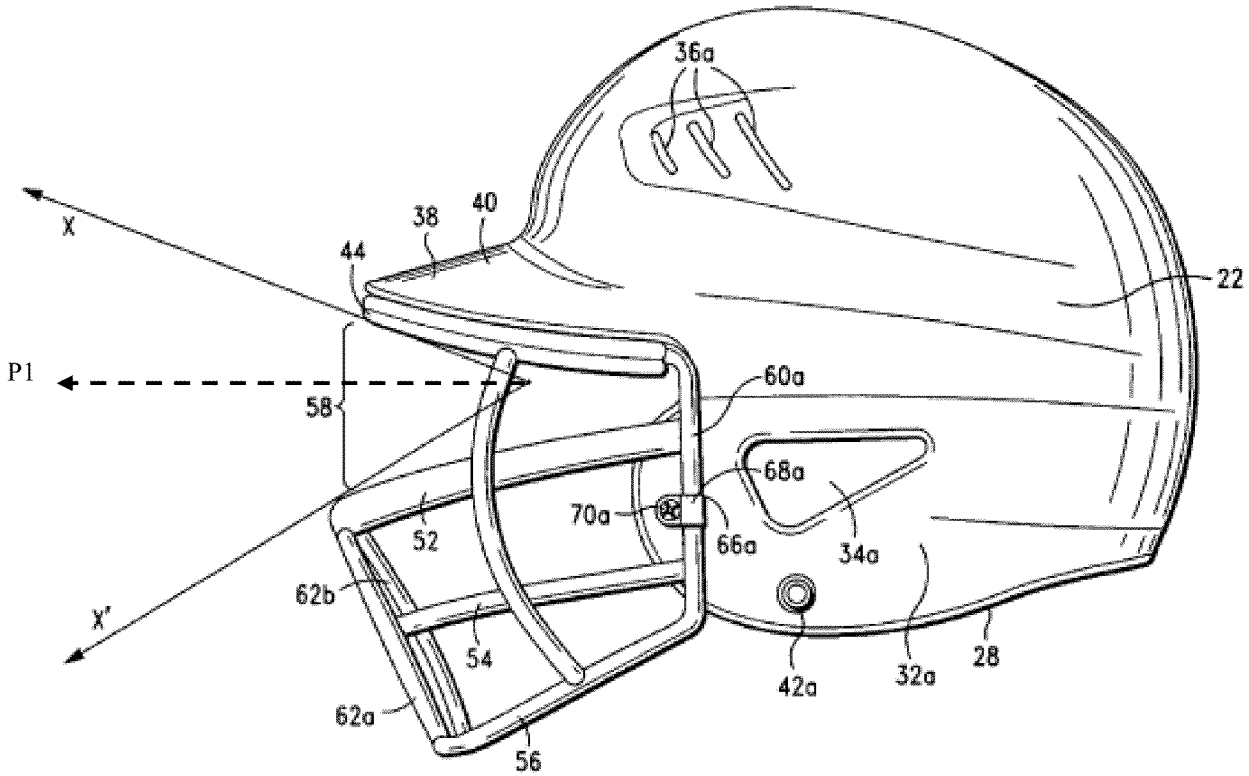
FIG. 2A (Prior Art)
FIGS. 2A, 2B, 2C, and 2D show the deficiencies of a facial protector with a static gap size, in accordance with embodiments of the present disclosure.
Figure 2B:
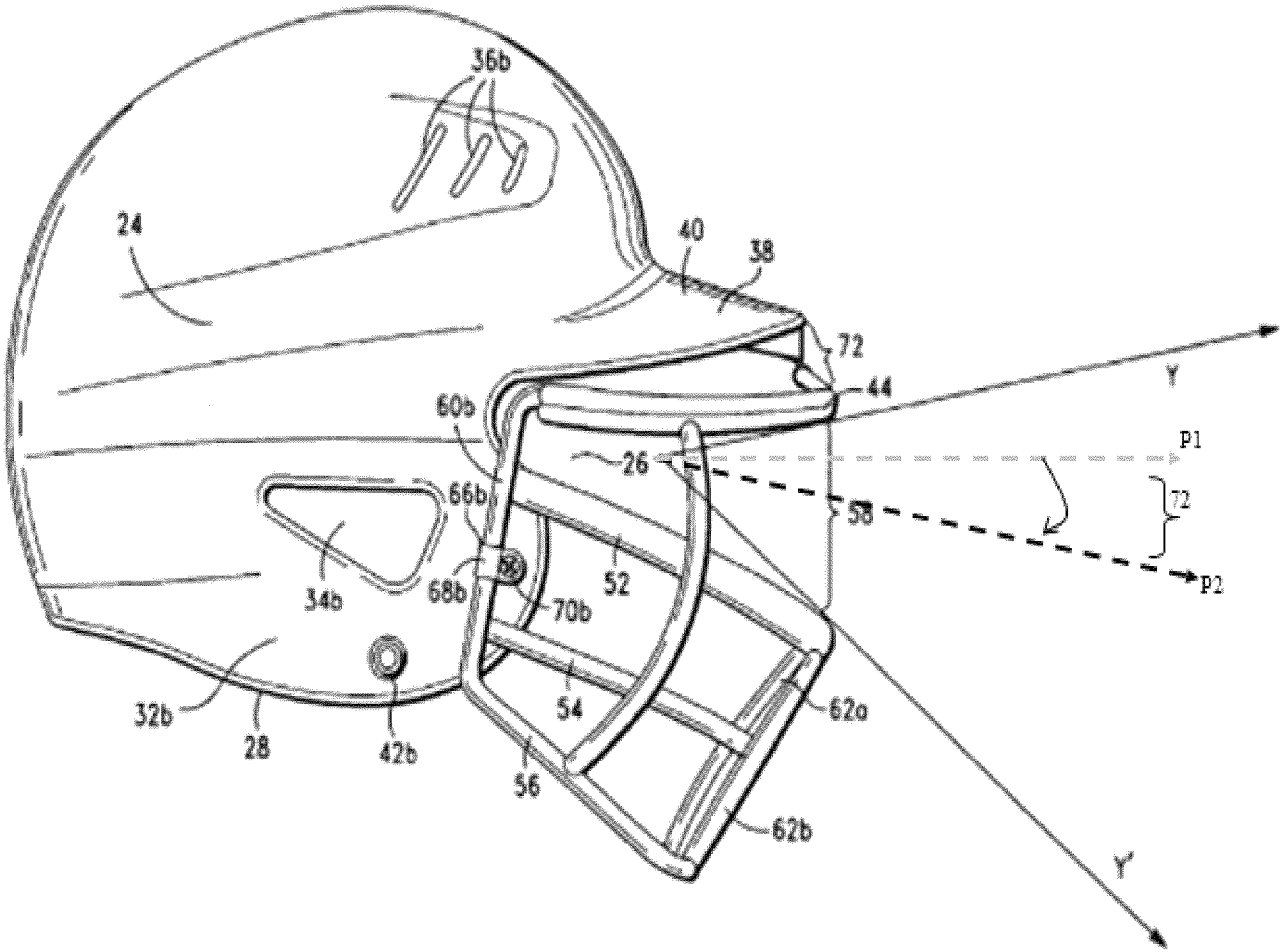
FIG. 2B (Prior Art)
Figure 2C:
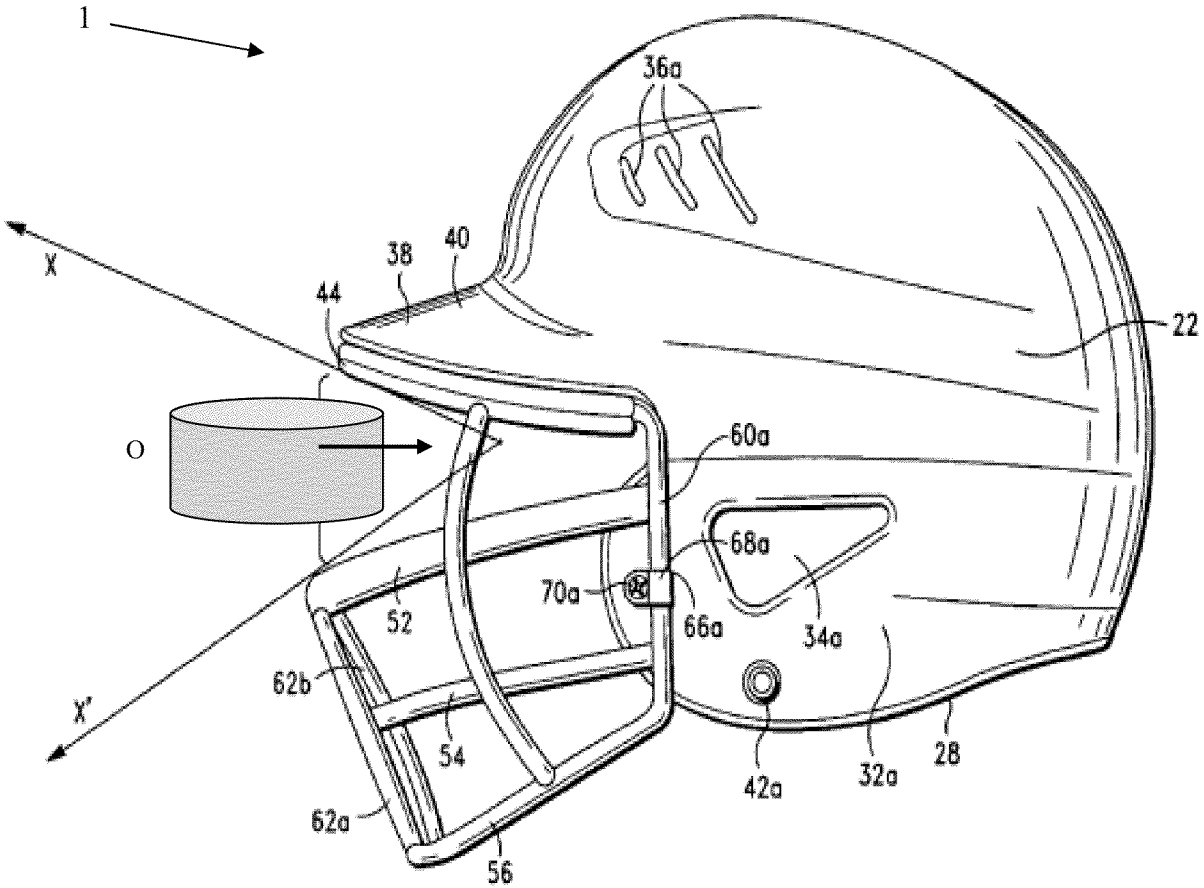
FIG. 2C (Prior Art)
Figure 2D:
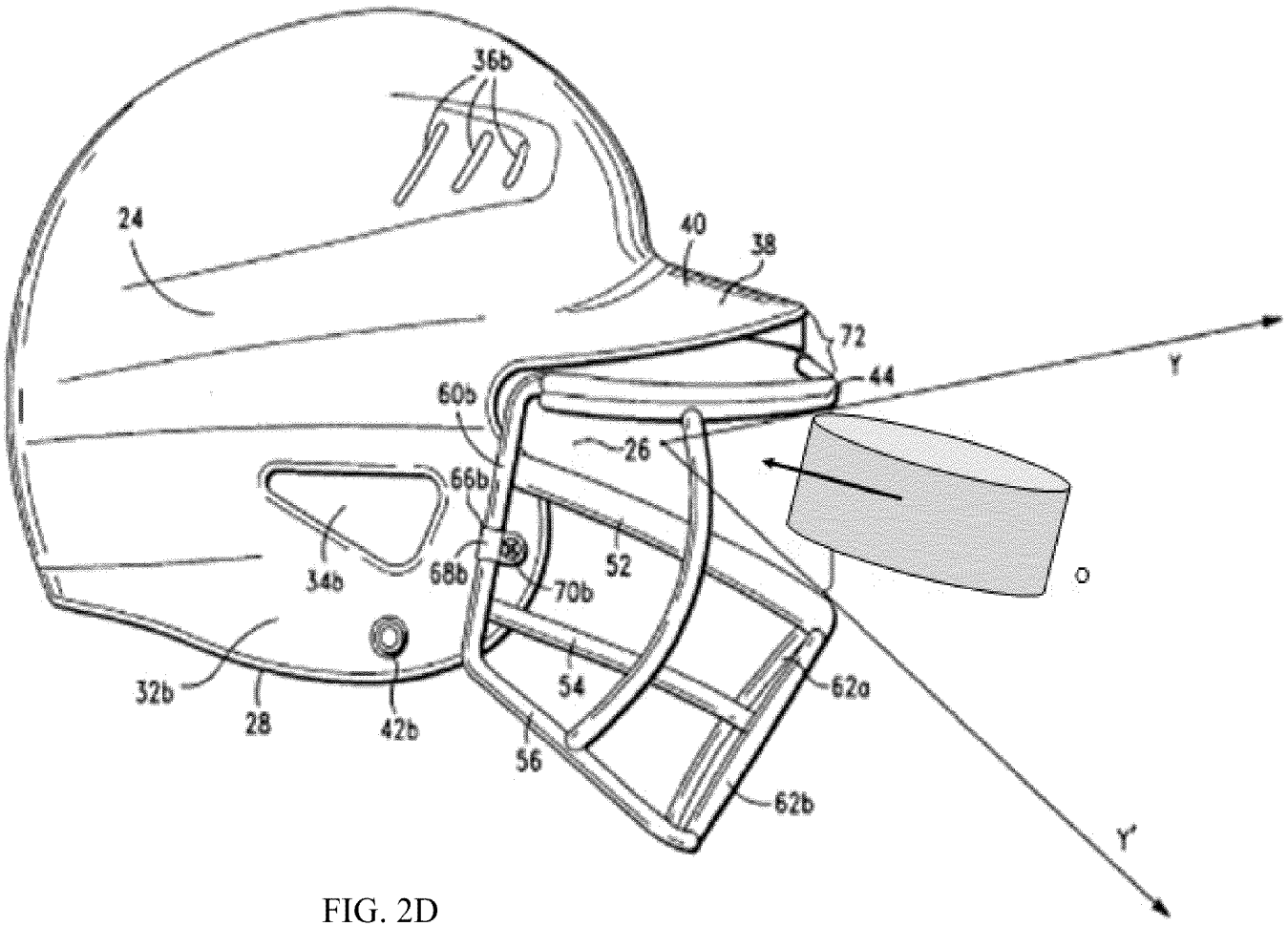
FIG. 2D (Prior Art)

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," "front," "back," etc., are used for convenience in referring to the accompanying drawings. In general, "above," "upper," "upward," etc. refer to a direction toward the Earth's surface, but is meant for illustrative purposes only, and the terms are not meant to limit the disclosure.

While the disclosure may be described hereinbelow with reference to head gear used in a sport, such as hockey, it should be understood that the disclosure is not limited to the specific configurations shown by the embodiments. Rather, one skilled in the art will appreciate that a variety of configurations may be implemented in accordance with embodiments herein.

Figure 3A:
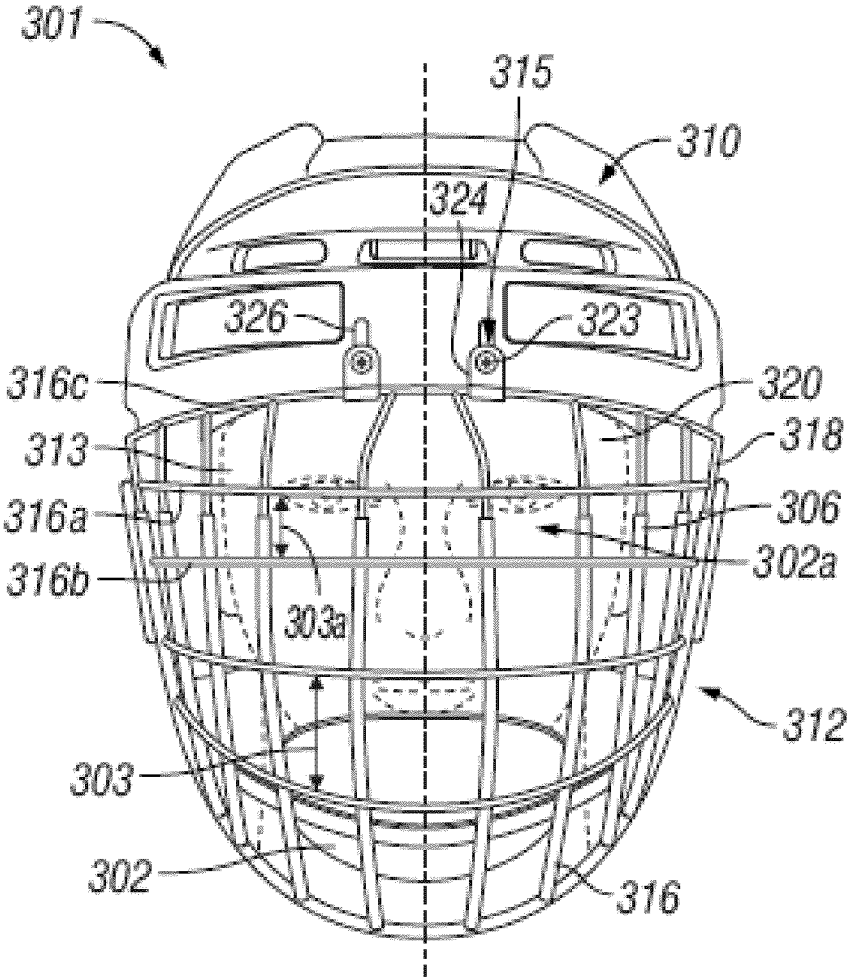
FIGS. 3A and 3B show a front view and a side view of a head gear assembly, in accordance with embodiments of the present disclosure.
Figure 3B:
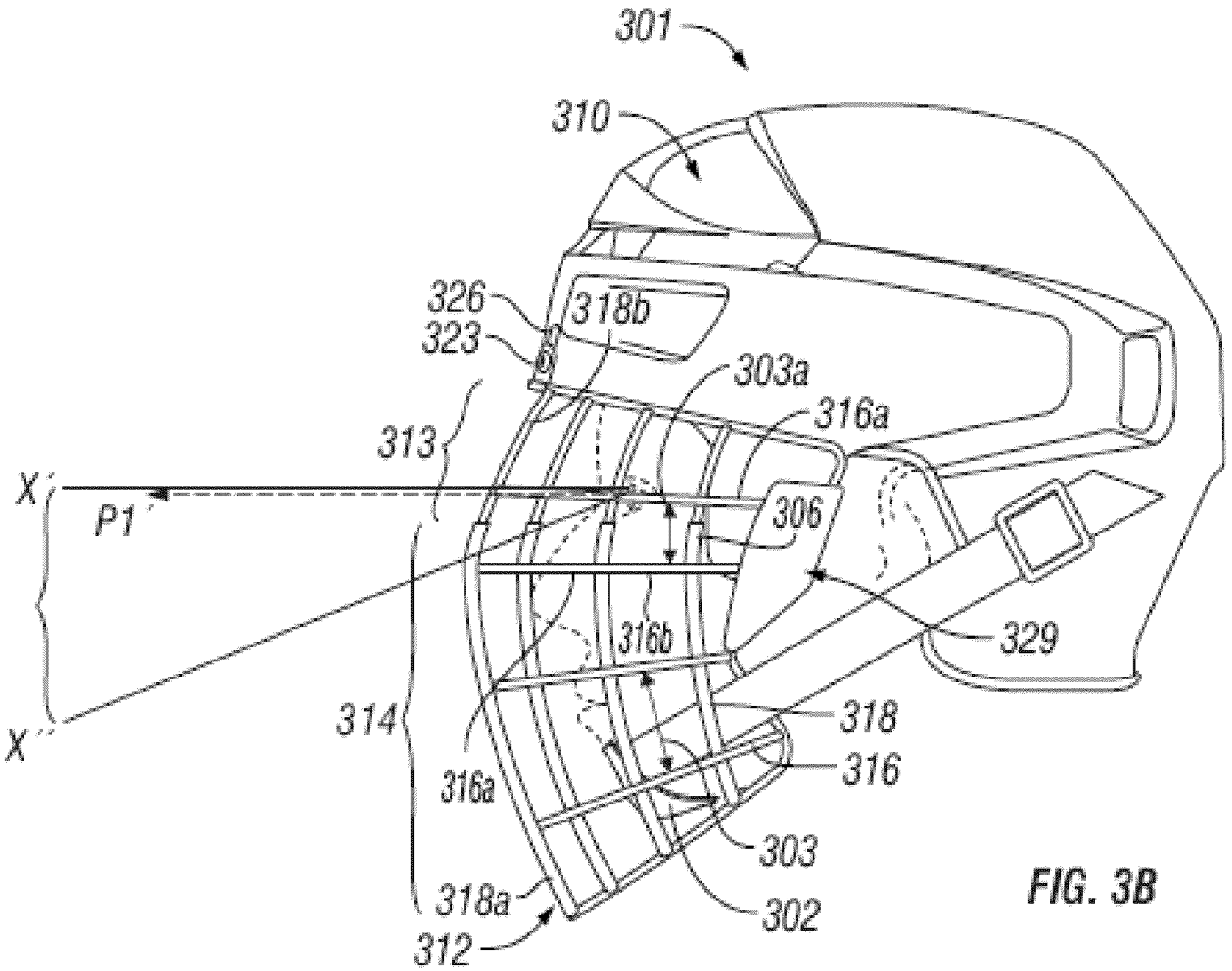

Referring now to FIGS. 3A and 3B, a front view and a side view of a head gear assembly according to embodiments of the present disclosure, is shown. As illustrated by FIGS. 3A and 3B together, the head gear assembly 301 may include a rigid shell 310 and a facial protector 312 coupled to the rigid shell 310. The coupling of the facial protector 312 to the rigid shell 310 may be by any means known in the art, such as rivets, straps, snaps, pivoting devices, etc. Any of the coupling devices may be configured for adjustment, as will be illustrated by examples described herein.

The facial protector 312 may include a plurality of generally horizontal members 316 crossed with and/or secured to a plurality of generally vertical members 318 as would be known to a person of ordinary skill in the art. For example, the horizontal members 316 and vertical members 318 may be welded together at various intersecting/crossing points 307, such that a "grid shaped" facial protector 312 may be formed. In some embodiments, the facial protector 312 may include a plurality of "gaps" 302 formed between the elements 316 and/or 318. In other embodiments, at least one of the gaps 302 may include a gap size 303. The gap size 303 may be determined by, for example, a height, a width, a diagonal or any other dimension of gap 302. The height (e.g., the gap size 303) of the gap 302, for example, may be determined by the distance between a first horizontal member 316*b* and a second horizontal member 316*a* directly above (or directly below) the first horizontal member 316*b*.

In one embodiment, the gap size 303 may be less than two inches; in still other embodiments, the size of the gap may be greater than two inches. However, the gap size is not meant to be limited and may vary in size depending on the particular application the head gear assembly 301 is being used for. The gap size 303 may also vary depending upon an amount of adjustment made to the gap size 303. The gap size could also be determined by the distance between other members, such as between two vertical members 318.

The gaps 302*a* in the facial protector 312 allow a user (i.e., wearer, donner, etc.) to have a line-of-sight P1' through the facial protector 301. The line of sight P1' may be determined by an angle of vision X'X" limited by the space between horizontal and/or vertical members 316 and 318. In one embodiment, the gap 302*a* may be an ocular gap. In another embodiment, the gap 302*a* may be configured with an adjustable gap size 303*a*. In one aspect, the gap size 303*a* may be adjustable between a range of gap sizes.

In an exemplary embodiment, the gap size 303*a* may be adjusted to suit a user's needs. Thus, the user may initially have a gap size such that a horizontal or vertical member impairs the range of vision. Accordingly, the user may adjust the gap vision in a limited amount to remove the impairment, while still maintaining a significant amount of safety. Therefore, the user may improve the operable performance of the head gear assembly without reducing the safety performance.

Accordingly, the head gear assembly 301 may be used in sports or activities that use a small gap size; however, with the adjustment of the gap size 303*a*, the head gear assembly may be configured with an increased gap size. The head gear assembly 301 may be used in sports or activities that do not require a small gap size. For example, the head gear assembly 301 may be used in the sport of hockey as a hockey helmet, but the head gear assembly may also be used for industrial purposes. For example, the head gear assembly 301 may be used by a construction worker or a welder.

Figure 4A:
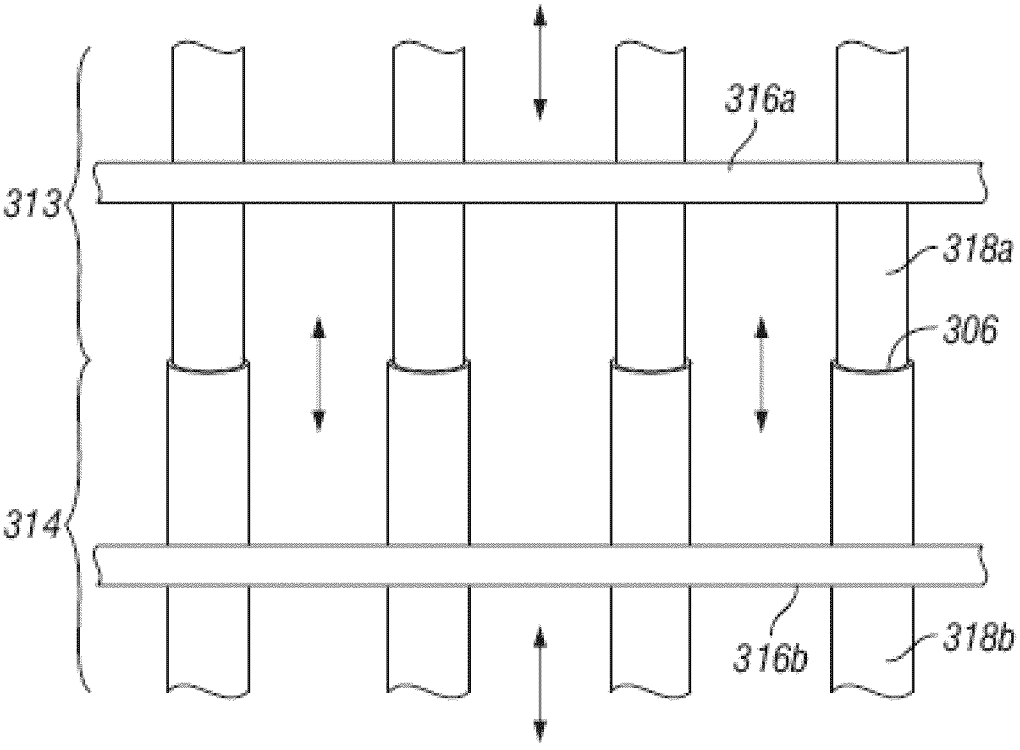
FIG. 4A shows various members of a facial protector telescopingly engaged with each other, in accordance with embodiments of the present disclosure.

Referring briefly to FIG. 4A, a snapshot of members telescopingly and/or slidingly engaged with each other according to embodiments of the present disclosure, is shown. FIG. 4A shows upper portion 313 engaged with the lower portion 314. In one embodiment, the upper portion 313 and the lower portion 314 are telescopingly engaged; however, the engagement between any portions of the head gear assembly 301 is not meant to be limited and may occur in other ways without leaving the scope of the disclosure.

The horizontal members 316 and the vertical members 318 may be any kind of material used for a facial protector. For example, the members 316 and 318 may be any kind of weldable carbon steel, or some other durable impact-resistant type material. In an exemplary embodiment, facial protector 312 may have an upper portion 313 telescopingly engaged with a lower portion 314, such that the upper portion 313 and the lower portion 314 may telescopingly (e.g., slidingly, movingly, etc.) move apart from each other. Each of generally vertical elements 318*a* in the upper portion 313 may be telescopingly engaged with corresponding vertical elements 318*b* in lower portion 314 so that as the gap size 303 may be adjusted as the upper portion 313 moves freely from the lower portion 314.

FIG. 4A illustrates a telescopingly engaged embodiment, such that the upper portion 313 and the lower portion 314 are may move freely from each other. In this manner, vertical members 318*a* may move inward and outward (e.g., up and down) from vertical members 318*b* at joint 306. Accordingly, a portion of the vertical members 318*a* may be configured with an outer diameter, D1, slightly smaller than the inner diameter, D2, of the vertical members 318*b*. It is to be understood that the vertical members 318*a* and 318*b* could be oppositely configured, such that the vertical members 318*b* could move inward and outward from the vertical members 318*a*. Additionally, the horizontal members 316, although not shown here, could be configured comparably, such that some horizontal members may move inwardly and outwardly from other horizontal members.

Figure 4B:
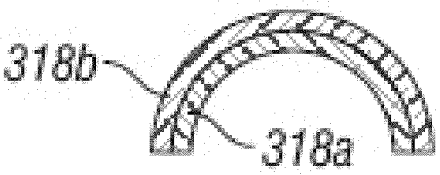
FIGS. 4B, 4C, and 4D show various lateral cross-sectional views of different embodiments of members of a facial protector engaged with each other, in accordance with embodiments of the present disclosure.
Figure 4C:
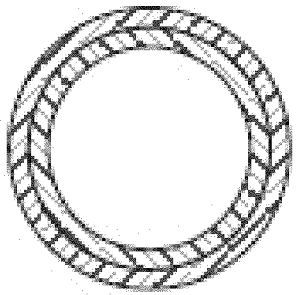
Figure 4D:
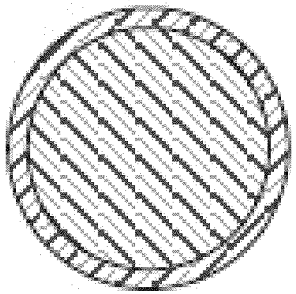

FIGS. 4B-4D illustrate the head gear assembly 301 may include any number of members configured in numerous fashions. For example, it is not necessary that any of the vertical members 318 and/or horizontal members 316 be tubular in nature; instead, they may be generally flat or semi-round shaped. The members may be configured as known to a person of ordinary skill in the art, such that some of the members may be telescopingly, slidingly, etc. engaged with one another. Moreover, FIGS. 4B-4D particularly illustrate that any of the tubular shaped members need not be hollow; instead, any of the members of the head gear assembly may also be, for example, tubular, non-tubular, solid, or combinations thereof.

Referring again to FIGS. 3A and 3B, the facial protector 312 may be adjustingly mounted to the rigid shell 310 by at least one clip and slot bracket assembly 315. The assembly 315 may include clips 324, which may be configured to couple with one of the horizontal members 316*c*. The at least one clip 324 may be connectively attached to a corresponding mating connection 326 disposed in the rigid shell 310. In one embodiment, the at least one clip 324 may be secured to the rigid shell 310 by fasteners 323.

There may also be at least one adjustingly mounted bracket assembly 329 that may be mounted on the helmet by fasteners (not shown) or the like. The mounted bracket assembly 329 may have a similar configuration as the slot bracket assembly 315. In addition, the mounted bracket assembly 329 may act as a mechanical stop for the facial protector 312. In this manner, the facial protector 312 may be properly positioned over a user's face.

The slot bracket assembly 315 may cooperate with the mounted bracket assemblies, such that once the assemblies 315 and/or 329 are adjusted (e.g., repositioned, etc.), the upper portion 313 may telescopingly move away (or toward) the lower portion 314. As illustrated, the facial protector 312 may have an adjusted gap size 303*b*. Notably, the angle of line of sight P1' has also not changed. This adjustment ability gives a user the ability to dynamically alter the gap 303*b*, greatly enhancing the flexibility of the head gear assembly 301.

Figure 5A:
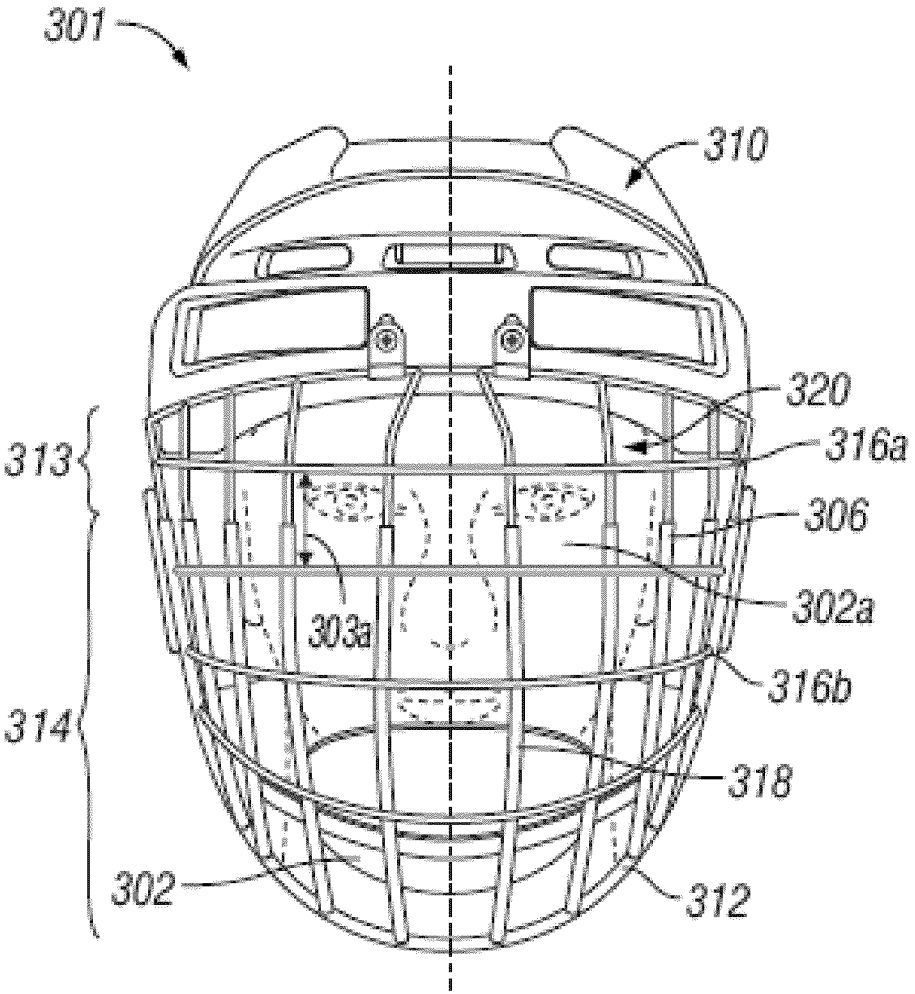
FIGS. 5A, 5B, 5C, and 5D show a front view and a side view of an adjusted facial protector, in accordance with embodiments of the present disclosure.
Figure 5B:
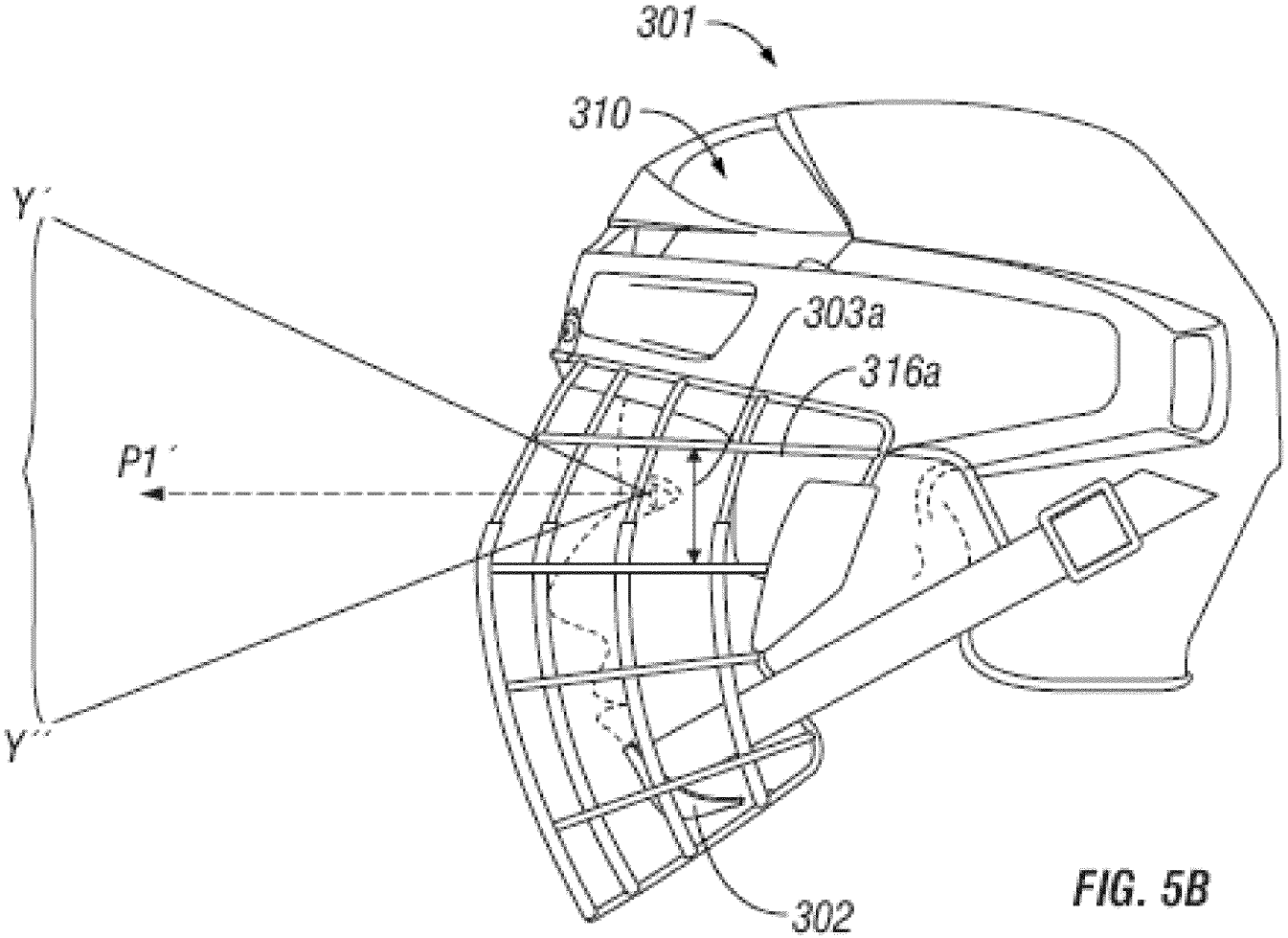
Figure 5C:
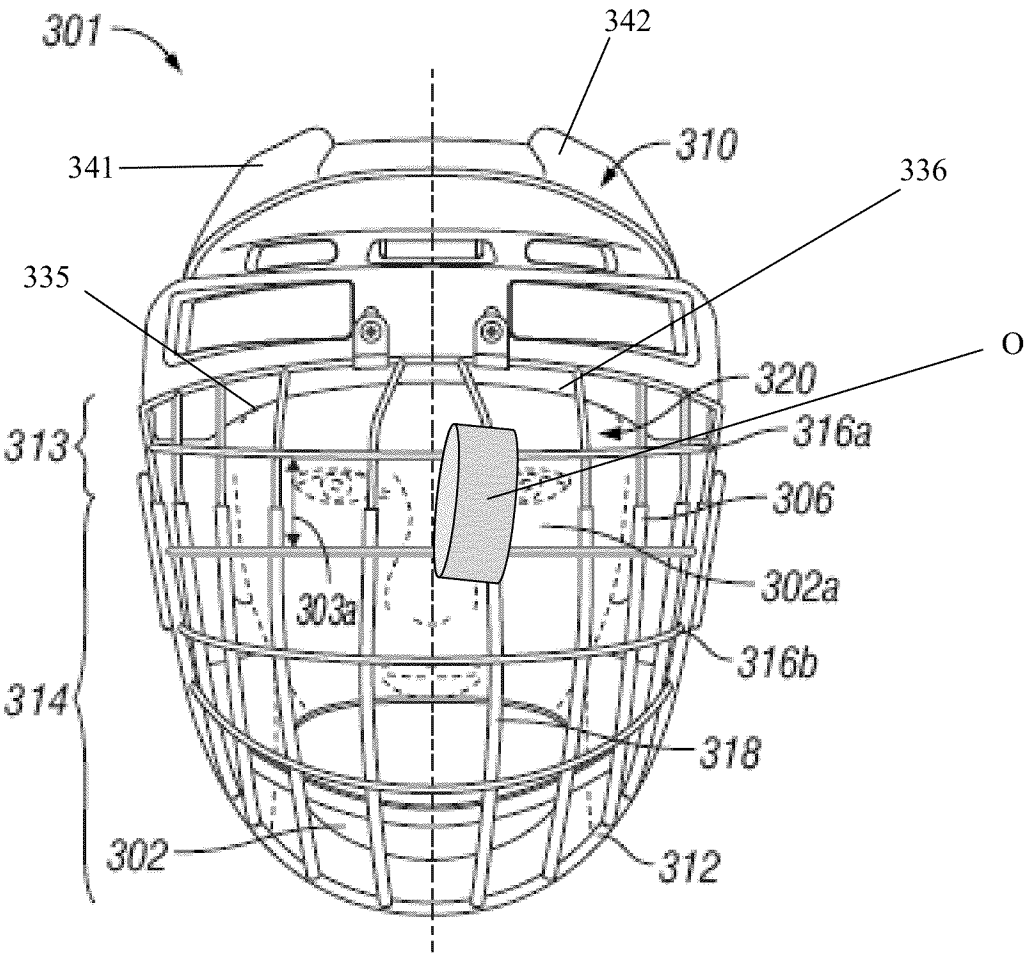
Figure 5D:
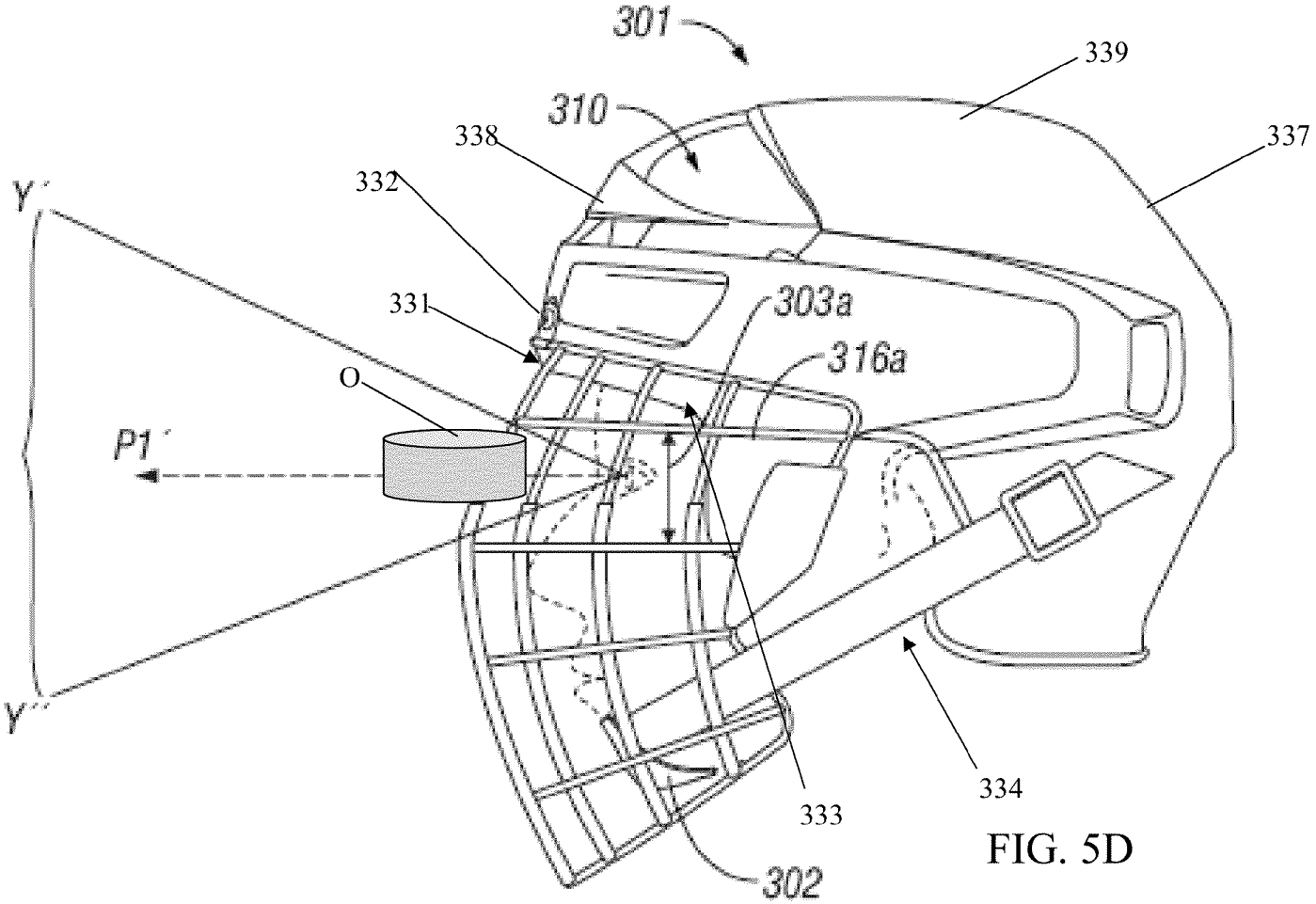

Referring to FIGS. 5A, 5B, 5C, and 5D, a detailed illustration of head gear assembly 301 according to embodiments of the present disclosure, is shown. As illustrated, the adjusted gap size 303*b* may be further defined by a plane, P1', which may define a line-of-sight. This plane P1' may remain unchanged before, during, and after the gap size 303*a* and/or 303*b* is adjusted. Analogously, the range of vision illustrated by previously by angle X'X" is now changed to angle Y'Y", such that the line-of-sight remains on plane P1' but is no longer hindered by a horizontal member 316*a*. Moreover, because viewing angle Y'Y" is now greater than X'X", user performance may be increased; however, safety performance is unchanged by the protection still provided against object O, as shown in FIGS. 5C and 5D.

Other aspects of the head gear assembly 301 may include an inner portion 331 that, upon donning, may contact a users head. The inner portion 331 may include an inner front side 332, and inner middle 333, and an inner rear side 334. In addition, inner portion 331 may have an inner left side 335 and an inner right side 336. The inner portion 331 may be configured to have a shock absorbing material (not shown) disposed in such a manner that a user's head is further protected from impact forces and the like.

The head gear assembly 301 may also have an outer portion 337 that, upon donning, may be exposed externally/outwardly from the user's head. The outer portion 337 may have an outer front side 338, and outer middle 339, and an outer rear side 340. In addition, outer portion 337 may have an outer left side 341 and an outer right side 342. In an embodiment, the inner portion 331 and the outer portion 337 may be configured to form an opening (not shown) that may be restricted when the facial protector 312 is operatively connected attached to the rigid shell 310.

It will be appreciated that the above description relates to the preferred embodiment by way of example only. Many variations on the embodiments disclosed herein will be obvious to those knowledgeable in the field, and such obvious variations are within the scope of the disclosure as described and claimed, whether or not expressly described.

For example, as previously mentioned, it should be clear that the facial protector 312 and any of the assemblies and adjusting devices could be adapted to be used with any form of protective headgear, such as catchers' masks for baseball and softball. The grid sizes and horizontal/vertical member diameter could be any that meet a required opening size and required impact resistance. It is not necessary for embodiments disclosed herein for the horizontal/vertical members to be telescopingly (e.g., slidingly, etc.) engaged in the region of the eyes and nose. For example, the region of the mouth could have one or more horizontal elements configured with the previously described telescoping configuration.

Further, none of the mounted assemblies described above require adjustable fastening rivets. For example, the mount assemblies could include a bolt and nut configuration, or as another alternative have a "quick adjust" type fastening where the connection merely has a "locked" (or tight, secure, etc.) setting and an "unlocked" (or loose, unsecure, etc.) setting, or any other coupling device as would be known to a person of ordinary skill in the art. Thus, other clip or fastening devices know in the art may be used without deviating from the scope of the present disclosure. As also mentioned, a similar configuration could be used on the horizontal members, which would then be similarly adjusted to change the gap size.

Embodiments disclosed herein also pertain to a method for adjusting a dynamic vision gap. The method may include an initial step of selecting an appropriate head gear for a desired activity. For example, if a user was going to be participating in the sport of hockey, the user may select an appropriate head gear accordingly. The method may also consist of donning the head gear assembly, which may include a rigid shell, as well as a facial protector connectively attached to the rigid shell. The facial protector may have a gap comprising a gap size, wherein the gap size is adjustable from a first size to a plurality of other sizes. The method may also include a step for adjusting the gap size from the first size to one of a plurality of other sizes.

Other embodiments may pertain to a method for adjusting an ocular gap size. The method may include an initial step of selecting an appropriate head gear for a desired activity. For example, if a user was going to be participating in the sport of hockey, the user may select an appropriate head gear accordingly. The method may also consist of donning the head gear assembly, which may include a rigid shell, as well as a facial protector connectively attached to the rigid shell. The facial protector may have a gap comprising a gap size, wherein the gap size is adjustable from a first size to a plurality of other sizes. Further, the facial protector may be configured to establish a plane that may define a line of sight, such that the line-of-sight remains unchanged when the gap size is adjusted. The method may also include a step for adjusting the gap size from the first size to one of a plurality of other sizes.

Further embodiments disclosed herein may pertain to a method of manufacturing a head gear assembly comprising. The steps for doing so may include forming a rigid shell, and producing a facial protector configured to movingly attach to the rigid shell to fashion a protective head gear. The facial protector may have a gap with a gap size, wherein the gap size may be adjustable from a first size to a plurality of any other sizes.

The facial protector may also have a plurality of generally horizontal elements, and a plurality of generally vertical elements. Each generally vertical element may be configured in an upper portion and a lower portion of the facial protector. In an embodiment, the upper portion and the lower portion may be telescopingly engaged together so that as the gap size is adjusted the upper portion may move freely from the lower portion. Additionally, the vertical elements and horizontal elements may be configured for crossing one another to form a grid, such that the grid may have the ocular gap disposed therein.

Advantageously, embodiments disclosed herein provide a user with the ability to dynamically alter a gap within a facial protector, thereby enhancing the flexibility of a head gear assembly. The user may be provided with any multitude of gaps and/or gap sizes. The impairment of vision may be reduced, and subsequently the performance of the head gear assembly may be increased. Beneficially, safety performance may remain unchanged. Also advantageously, a user may have the ability to fractionally, incrementally, or otherwise, adjust a dynamic gap to provide improved range of vision and/or overall performance of a head gear assembly. Of significant benefit is the combination of improved vision, reduced impairment, improved ventilation, and maintained safety performance.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed:

1. A head gear assembly comprising:
a shell configured for wearability on a users head;
a facial protector connectively attached to the shell further comprising:
a first element;
a second element positioned approximately parallel to the first element;
a third and fourth element positioned approximately perpendicular to one or both of the first element and the second element;
a gap further comprising a gap size defined by the position of a combination of at least two of the first element, the second element, the third element, and the fourth element,
wherein the gap size is adjustable between a plurality of gap sizes, wherein the first element is movingly engaged with the second element, and wherein the first element moves freely from the second element as the gap size is adjusted.

2. The head gear assembly of claim 1, wherein the shell comprises:
an inner portion;
an outer portion coupled with the inner portion;
wherein the inner portion and the outer portion are configured to form an opening that is restricted by the facial protector.

3. The head gear assembly of claim 1, wherein the head gear is designed for use in contact sports.

4. The head gear assembly of claim 1, wherein the head gear is a hockey helmet.

5. The head gear assembly of claim 1, wherein the shell comprises:
a first pivot mechanism;
a second pivot mechanism; and
an adjusting device;
wherein the facial protector piotably attaches to the shell via at least one of the first pivot mechanism, the second pivot mechanism, and the adjusting device.

6. The head gear assembly of claim 5, wherein the gap size is adjusted by operating the adjusting device.

7. The head gear assembly of claim 1, wherein the shell comprises:
a first pivot mechanism;
a second pivot mechanism; and
an adjusting device;
wherein the head gear is a hockey helmet, wherein the facial protector pivotably attaches to the shell via at least one of the first pivot mechanism and the second pivot mechanism, wherein the gap size is adjusted by operating the adjusting device.

8. A head gear assembly for protecting a user's head, the assembly comprising:
a shell;
a facial protector connectively attached to the shell further comprising:
a plurality of generally vertically oriented elements;
a plurality of elements arranged approximately perpendicular to one or more of the plurality of generally vertically oriented elements;
a gap further comprising a gap size, wherein the gap size is adjustable between a plurality of gap sizes,
wherein at least one of the plurality of generally vertical elements has an upper portion movingly engaged with a lower portion, and wherein the upper portion moves freely from the lower portion as the gap size is adjusted.

9. The head gear assembly of claim 8, wherein the rigid shell comprises:
a left side;
a right side;
a top side;
a first pivot mechanism disposed on the left side;

a second pivot mechanism disposed on the right side;

an adjusting device disposed on the top side, wherein the facial protector connectively attaches to the rigid shell via the first pivot mechanism, the second pivot mechanism, and the adjusting device.

10. The head gear assembly of claim 9, wherein the gap size is adjusted by operating the adjusting device.

11. The head gear assembly of claim 10, wherein the head gear is a hockey helmet.

12. The head gear assembly of claim 10, wherein the facial protector comprises an upper portion movingly engaged with a lower portion.

13. A head gear assembly comprising:

a shell configured use on a human head, the shell further comprising:

an inner portion;

an outer portion coupled with the inner portion;

a facial protector connectively attached to the shell further comprising:

a first element;

a second element positioned approximately parallel to the first element;

a third and fourth element positioned approximately perpendicular to one or both of the first element and the second element;

a gap further comprising a gap size defined by the position of a combination of at least two of the first element, the second element, the third element, and the fourth element, wherein the gap size is adjustable between a plurality of gap sizes, wherein the first element is movingly engaged with the second element, wherein the first element moves freely from the second element as the gap size is adjusted, and wherein the inner portion and the outer portion are configured to form an opening that is restricted by the facial protector.

14. The head gear assembly of claim 13, wherein the shell comprises:

a pivot mechanism configured for pivotable attachment of the facial protector therewith.

15. The head gear assembly of claim 14, the assembly further comprising an adjusting device.

16. The head gear assembly of claim 15, wherein the gap size is adjusted by operating the adjusting device.

* * * * *